US006662608B1

(12) United States Patent
Baukholt

(10) Patent No.: US 6,662,608 B1
(45) Date of Patent: Dec. 16, 2003

(54) CENTRAL LOCKING DRIVE

(75) Inventor: Theo Baukholt, Kriftel (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/721,911

(22) Filed: Nov. 24, 2000

(30) Foreign Application Priority Data

Nov. 25, 1999 (DE) ..... 199 56 674

(51) Int. Cl.[7] ..... E05B 65/36

(52) U.S. Cl. ..... 70/264; 70/262; 70/277; 292/201

(58) Field of Search ..... 70/262–264, 256, 70/257, 277, 278, 279; 292/201, 336.3, 199, 216

(56) References Cited

U.S. PATENT DOCUMENTS

| | | | | | |
|---|---|---|---|---|---|
| 4,762,348 | A | * | 8/1988 | Matsumoto | 292/201 |
| 5,534,846 | A | * | 7/1996 | Kuroda | 340/426 |
| 5,582,448 | A | * | 12/1996 | Inoue | 292/336.3 |
| 5,673,578 | A | * | 10/1997 | Roos | 70/264 |
| 5,699,685 | A | * | 12/1997 | Jahrsetz et al. | 70/264 |
| 5,802,894 | A | * | 9/1998 | Jahrsetz et al. | 70/264 |
| 5,833,282 | A | * | 11/1998 | Ikeda | 292/201 |
| 5,887,466 | A | * | 3/1999 | Yoshizawa | 70/257 |
| 5,911,763 | A | * | 6/1999 | Quesada | 292/36 |
| 6,067,826 | A | * | 5/2000 | Holloway et al. | 292/201 |
| 6,164,148 | A | * | 12/2000 | Brouwer | 192/48.92 |
| 6,393,878 | B1 | * | 5/2002 | Fayngersh et al. | 292/169.14 |

FOREIGN PATENT DOCUMENTS

| | | |
|---|---|---|
| DE | 3631043 | 3/1988 |
| DE | 3908594 | 9/1990 |
| DE | 4108507 | 9/1992 |
| DE | 4222018 | 6/1993 |
| DE | 4222868 | 1/1994 |
| DE | 4421808 | 1/1995 |
| DE | 4413904 | 10/1995 |
| DE | 19635415 | 3/1998 |
| DE | 19702420 | 7/1998 |
| DE | 19706657 | 8/1998 |
| DE | 19739340 | 3/1999 |

* cited by examiner

*Primary Examiner*—Anthony Knight
*Assistant Examiner*—André L. Jackson
(74) *Attorney, Agent, or Firm*—Martin A. Farber

(57) ABSTRACT

A central locking drive (10) serves for the actuation of various locking functions of a door lock, especially in motor vehicles' and has two drive members (18, 20, 22, 24), which are each adjustable between an inoperative position and an activated position. In order to be able to actuate additional locking functions' such as child safety for example, automatically, an additional drive member or expensive detection of intermediate positions of the two drive members has hitherto been necessary. In order to avoid this expense there is provided an operating element (26), which is moveable between a neutral position and at least one operating position, the attainment of a particular operating position of the operating element (26) being dependent upon the order in which the two drive members (18, 22) are activated. The operating element is displaced, for example, by interacting cam elements on the operating element (26) and the drive members.

9 Claims, 7 Drawing Sheets

CENTRAL LOCKING DRIVE

FIELD AND BACKGROUND OF THE INVENTION

The invention relates to a central locking drive for the actuation of various locking functions of a door lock, especially in motor vehicles' with two drive members, which are each displaceable between an inoperative position and an activated position.

In addition to the known locking functions of central locking and central unlocking, the other function mostly demanded of present-day central locking systems is that of central security, in which unlocking of the external door handle and/or opening of the door by operating the internal door handle is prevented. This is required for anti-theft protection, since a vehicle door in this position cannot be readily opened even after smashing in a vehicle window. In order to be able to actuate this third locking function, it must be possible for the central locking drive to run into a third position, which can be achieved, for example, by means of an additional second drive member, such as a motor or a lifting magnet, or by purposely assuming an intermediate position of the first drive member with the aid of a switch or potentiometer, for example, the two limit stops of the drive member and the intermediate position defined by the switch or the potentiometer defining the three operating positions in the case of an intermediate position.

Yet a further locking function, that is child safety, is necessary on the rear doors of a motor vehicle. This is basically intended to prevent opening of the door by means of the internal door handle, but in the central locking position to permit unlocking of the external door handle by operating the internal door handle, since otherwise with central locking and child safety activated the central security function would virtually be engaged.

The additional function has hitherto generally been achieved by mechanical intervention in the lock with the door open, whereas an additional drive member is required for integration into the central locking drive. Consequently either three drive members at correspondingly high cost or a solution with two drive members and an electrical switch for detecting an intermediate position are required in order to achieve all the above-mentioned locking functions electrical switches however, being just as highly expensive in terms of circuitry as the detection of intermediate positions by means of potentiometers and having a certain susceptibility to malfunction.

SUMMARY OF THE INVENTION

The object of the present invention is to create a central locking drive that relies on just two drive members and permits actuation of at least the desired locking functions central locking, central unlocking central security and child safety simply by displacement of the drive members between their limit positions.

According to the invention the object is achieved by a central locking drive of the type initially described, in which an operating element is provided which is moveable between a neutral position, which it assumes when the two drive members assume their inoperative position, and at least one operating position, the attainment of a particular operating position of the operating element being dependent upon the order in which the two drive members are activated.

In the solution according to the invention the additional locking function is defined by the order in which the two drive members are actuated, there being no need to arrest these in intermediate positions. In terms of control technology the encountering of limit stops is very simple, the differing sequence for the actuation of the two drive members also being very easily accomplished in terms of control technology. The elimination of a third drive member or an additional electrical switch provides for savings in the overall space required and in the weight of the central locking drive, savings also being achieved through being able to dispense with the corresponding electrical wiring.

Provision is preferably made so that a first drive member, in its activated position, deadlocks or interrupts the connection between an internal door handle and the door lock, and the second drive member, in its activated position, deadlocks or interrupts the connection between an external door handle and the door lock. An interruption or deadlocking of the connections by the drive members in their inoperative position is also feasible depending on the definition. The connection between the door handles and the door lock may be of mechanical or electrical design.

In a further preferred embodiment of the invention it is proposed that the operating element be moveable by operation of the first drive member and subsequently moving the second drive member into a first operating position, in which it is possible to unlock the external door handle by operating the internal door handle.

In a central locking drive of this type the aforementioned locking functions are configured so that the central unlocking function is engaged when the drive members are in the inoperative position, the child safety function with external door handle unlocked is engaged when the first drive member is activated and the second drive member is in the inoperative position, the central locking function with the facility for opening the door from inside is engaged when the second drive member is activated and the first drive member is in the inoperative position, the child safety and central locking function with the facility for unlocking the external door handle by operating the internal door handle is engaged when the first drive member is activated first and the second drive member is activated subsequently, and the central security function is engaged when the second drive member is activated first and the first drive member is activated subsequently.

It is also feasible that in one operating position the operating lever might interrupt or deadlock a facility for unlocking the external door handle by means of the internal door handle. Such a design is conceivable in combination with a facility, purposely established by the operating element in its first operating position, for unlocking the external door handle by means of the internal door handle or even in the case of a central locking drive, in which such a facility exists whenever the operating element is not in a certain operating position.

Interacting cam elements are preferably provided on the operating element and on each of the drive members respectively, which on activation of the first drive member cause the operating element to be shifted into a first intermediate position and on subsequent activation of the second drive member cause the operating element to be shifted further into the first operating position, and on initial activation of the second drive member cause the operating element to be shifted into a second intermediate position and on subsequent activation of the first drive member cause it to be shifted into a limit position or second operating position other than the first operating position.

Such a solution for operation of the first operating element by the drive members in which the cam elements provided on the operating element have, for example, lifting flanks inclined in relation to the direction of movement of the cam elements on the drive members permits simple mechanical driving of the operating element into the required operating position by engaging the limit positions of the drive members.

The operating element is preferably returned towards its neutral position by means of a return spring. Alternatively a mechanical drive into the neutral position by returning the drive members to their inoperative position is also feasible, for example.

The central locking drive according to the invention may in principle rely on widely differing types of drive members such as motors or electromagnets for example. Thus the drive members in a preferred embodiment of the invention have electric drive motors which are each traversable between two stops which represent the inoperative position or the activated position of the respective drive member. Electric drive motors are of very compact construction, have only a relatively low power input and are very quiet in operation, it being possible to detect the stop positions for switching off the drive motor by detecting the power input. The drive motors preferably drive spindles which engage with adjusting nuts on which the cam elements are arranged. In order to guide the operating lever accurately between its various positions it may be pivotally mounted, although a linear guide, for example, is also conceivable.

BRIEF DESCRIPTION OF THE DRAWINGS

One embodiment of the invention will be examined in more detail below with reference to the figures of the drawings attached, in which.

DETAILED DESCRIPTION OF THE PREFERRED EMBODIMENT

Figure 1:
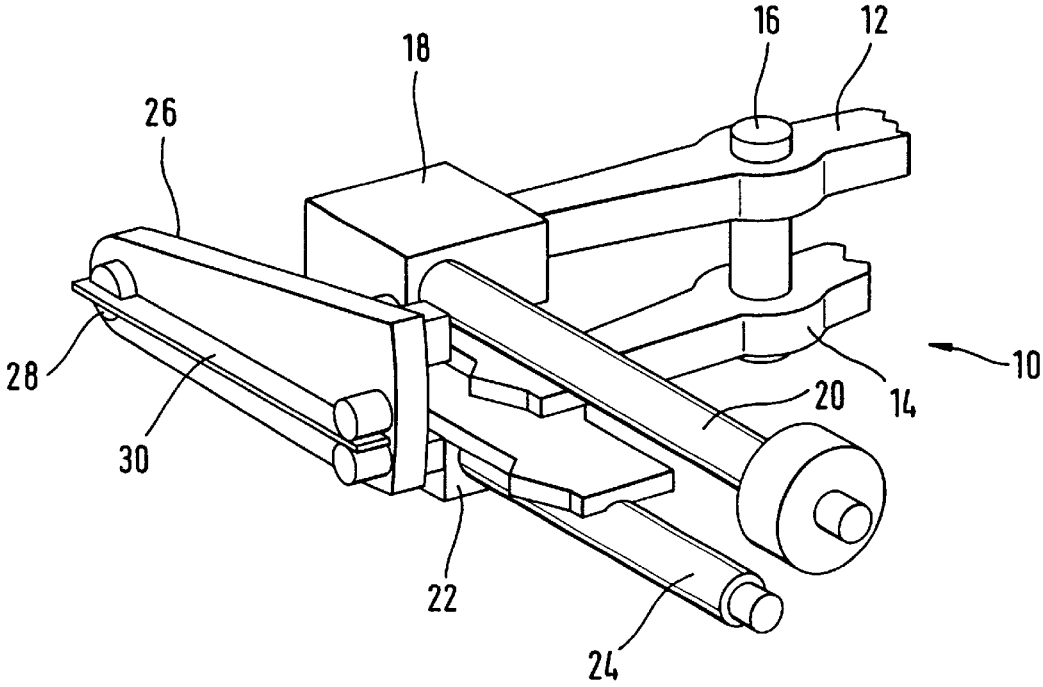
FIG. 1 shows a diagrammatic oblique view of a central locking drive.

The central locking drive 10 represented in FIG. 1 has a first operating lever 12, by means of which the connection between an internal door handle (not shown) and a door lock (likewise not shown) can be deadlocked or interrupted, and a second operating lever 14, which acts correspondingly on the connection between an external door handle (not shown) and the door lock. The two operating levers 12, 14 are mounted so that they can pivot about a common axis of rotation 16.

The first operating lever 12 is connected to a first adjusting nut 18, which engages with the external thread of a first threaded spindle 20, which can be driven by a first electric drive motor (not shown).

The second operating lever 14 is connected to a second adjusting nut 22, which engages with the external thread of a second threaded spindle 24, which can in turn be driven by a second electric motor (likewise not shown).

By means of the electric drive motors the two adjusting nuts 18, 22 are traversable between two stops which define the inoperative position or the activated position of the respective drive members.

In addition to the two adjusting nuts 18, 22 the central locking drive 10 has an operating element 26, which is mounted so that it can pivot about a swivel axis 28. In order to effect a return of the operating element 26 following displacement, a return spring is provided, which is designed as leaf spring and is fixed to the swivel axis 28.

The central locking drive furthermore has a device (not shown), intended for generally unlocking the external door handle by operating the internal door handle, these functions being described in more detail below.

Figure 2:
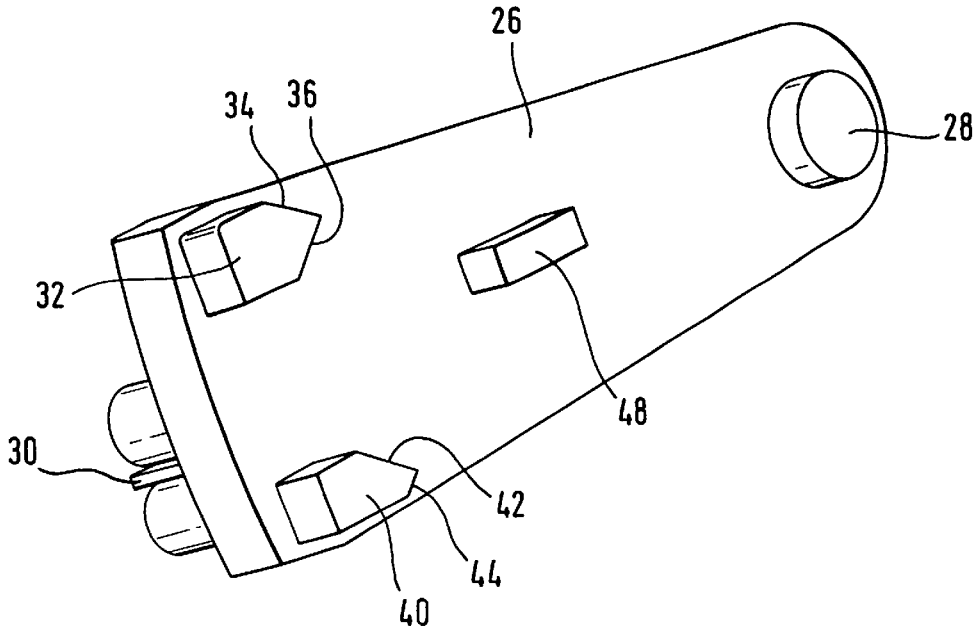
FIG. 2 shows an oblique view of the operating element of the central locking drive according to FIG. 1.

FIG. 2 shows an oblique view of the operating lever 26 from the side facing the adjusting nuts 18, 22. Also visible in addition to the swivel axis 28 are a first control cam 32 with two inclined lifting flanks 34, 36, which interacts with a first actuating cam 38 (see FIGS. 3–7) on the first adjusting nut 18, and a second control cam 40, which likewise has two inclined flanks 42, 44 and interacts with a second actuating cam 46 on the second adjusting nut 22. A locking cam 48, which will be explained in more detail later, is also provided on the operating element 26 in an approximately central position.

The interaction of the cam elements that is the interaction of the actuating cams 38, 46 with the control cams 32, 40, is illustrated in FIGS. 3–7. For this purpose only the adjusting nuts 18, 22 and the operating element 26 are shown. With the adjusting nuts 18, 22 in the position represented in FIG. 3 the central locking is in the centrally unlocked position, in which the door lock can be operated both by the internal door handle and the external door handle. The operating element 26 is in its neutral position.

Figure 3:
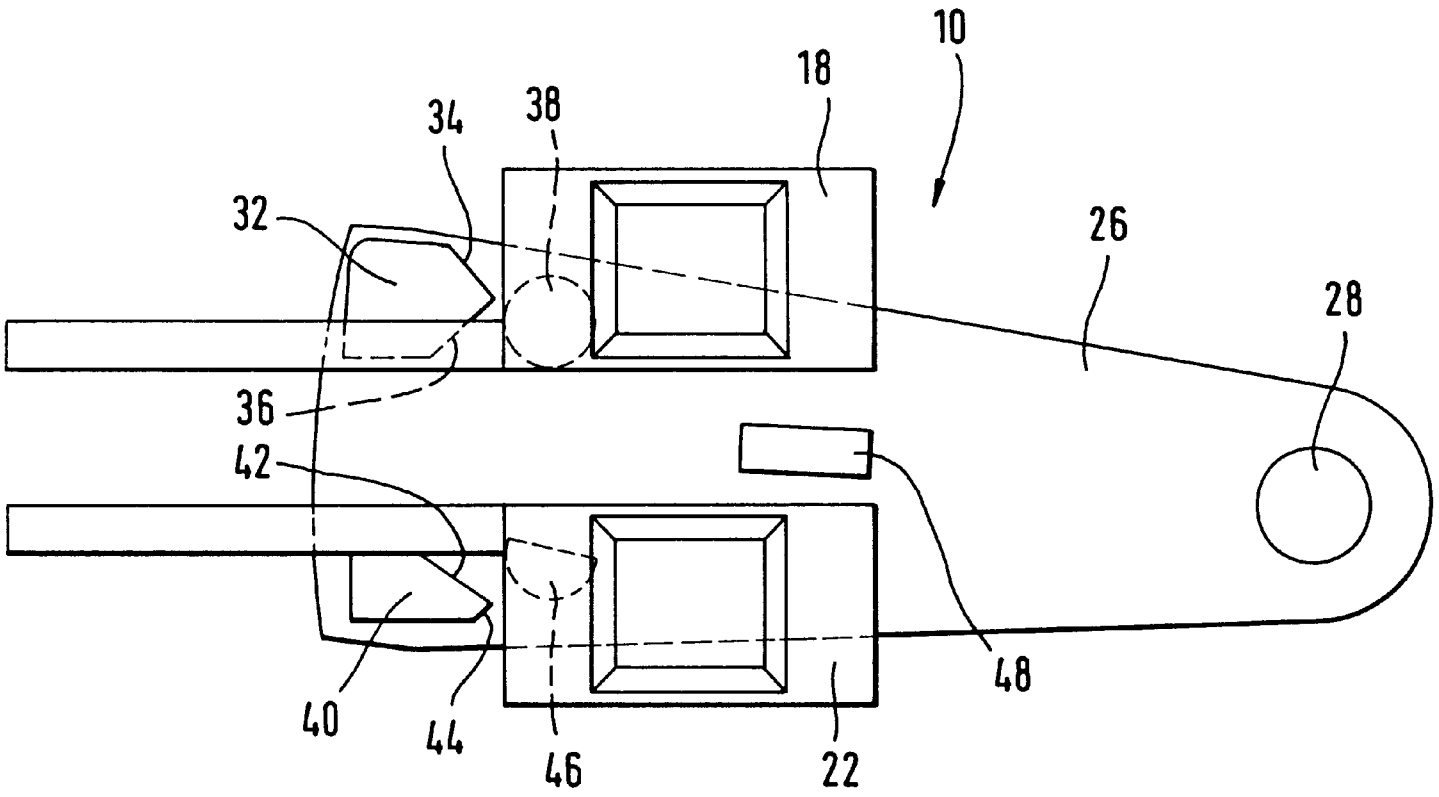
FIGS. 3 to 7 show diagrams of the central locking drive according to FIG. 1 in various operating positions.
Figure 4:
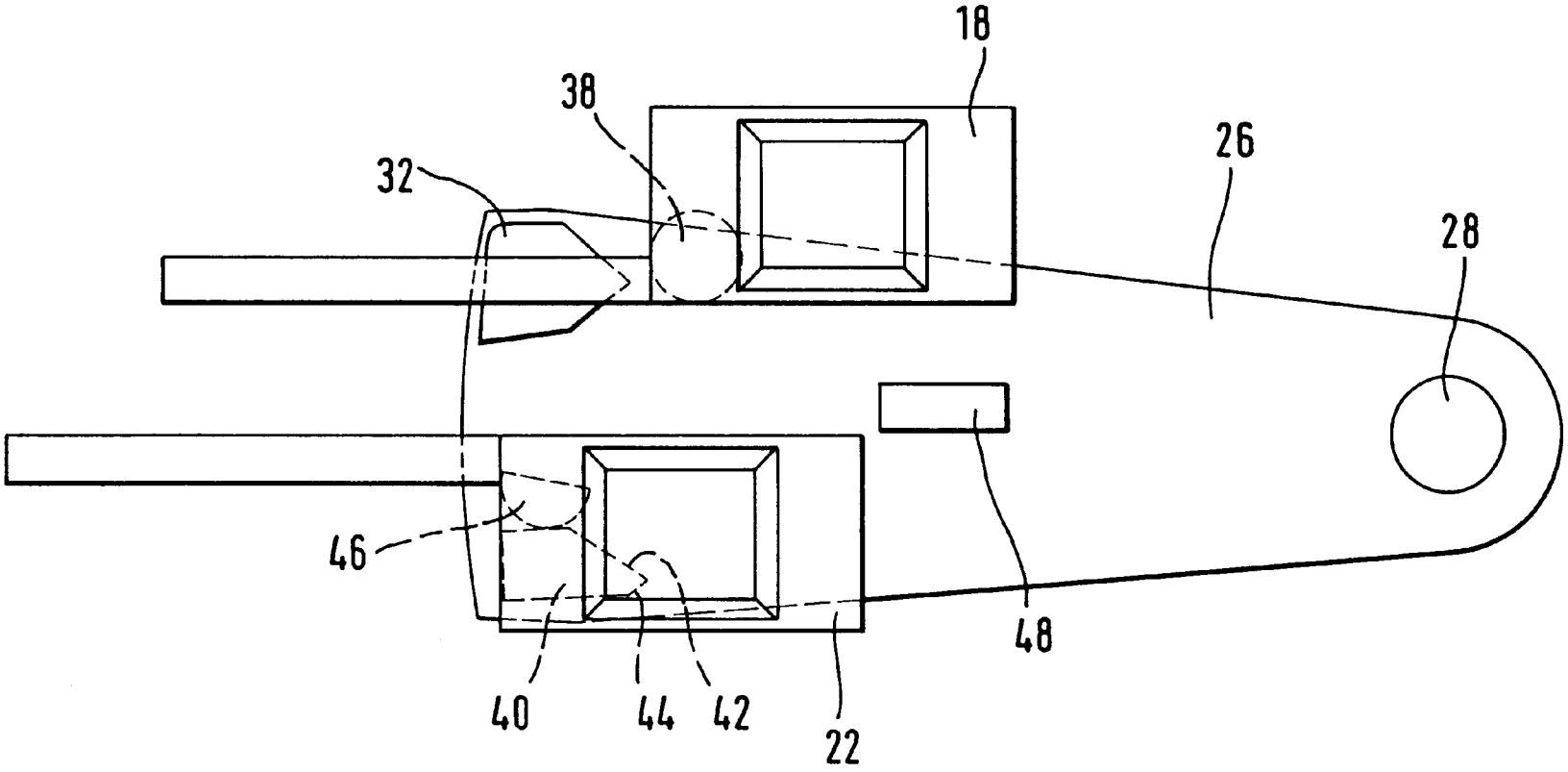
Figure 5:
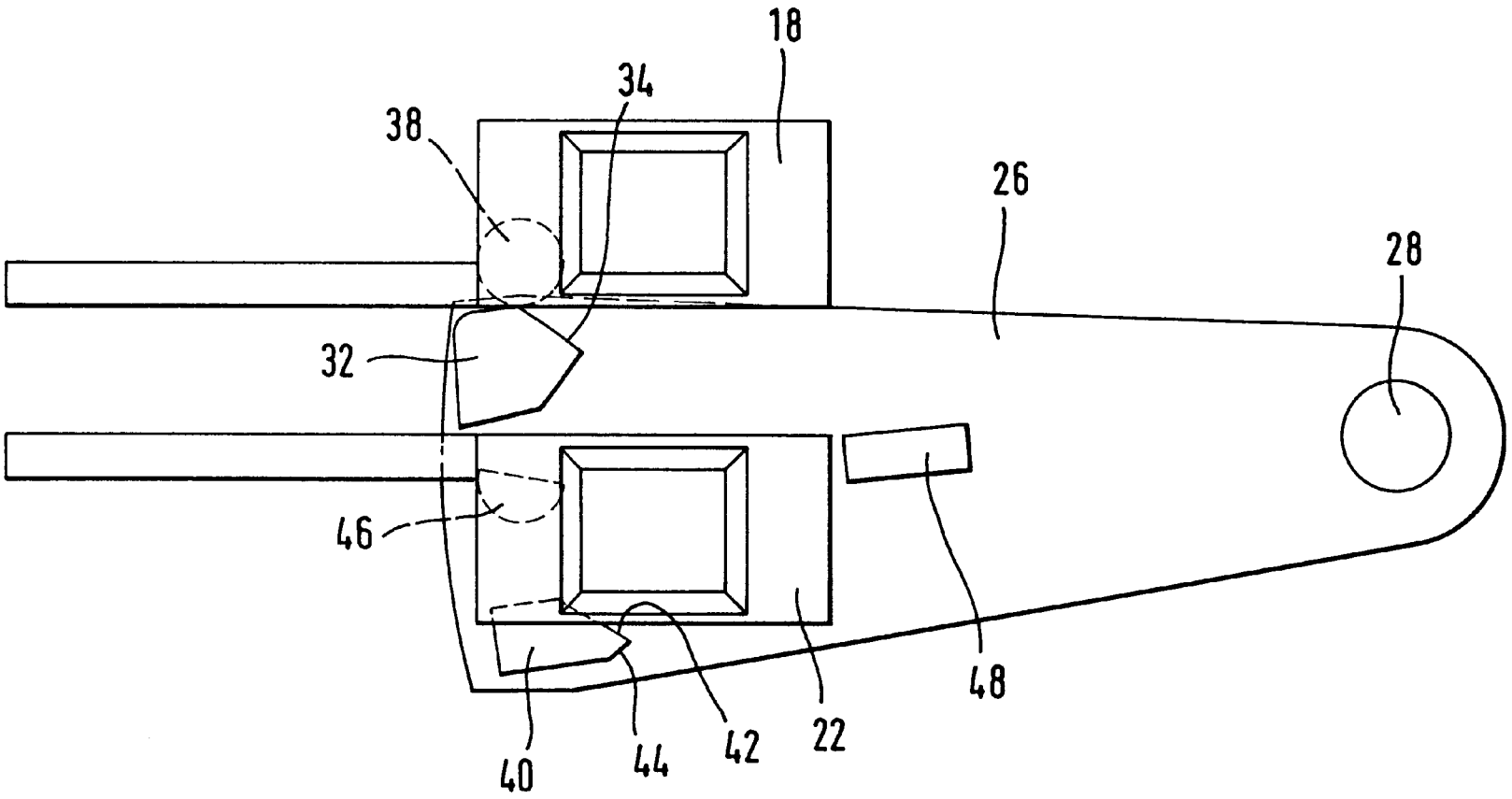
Figure 6:
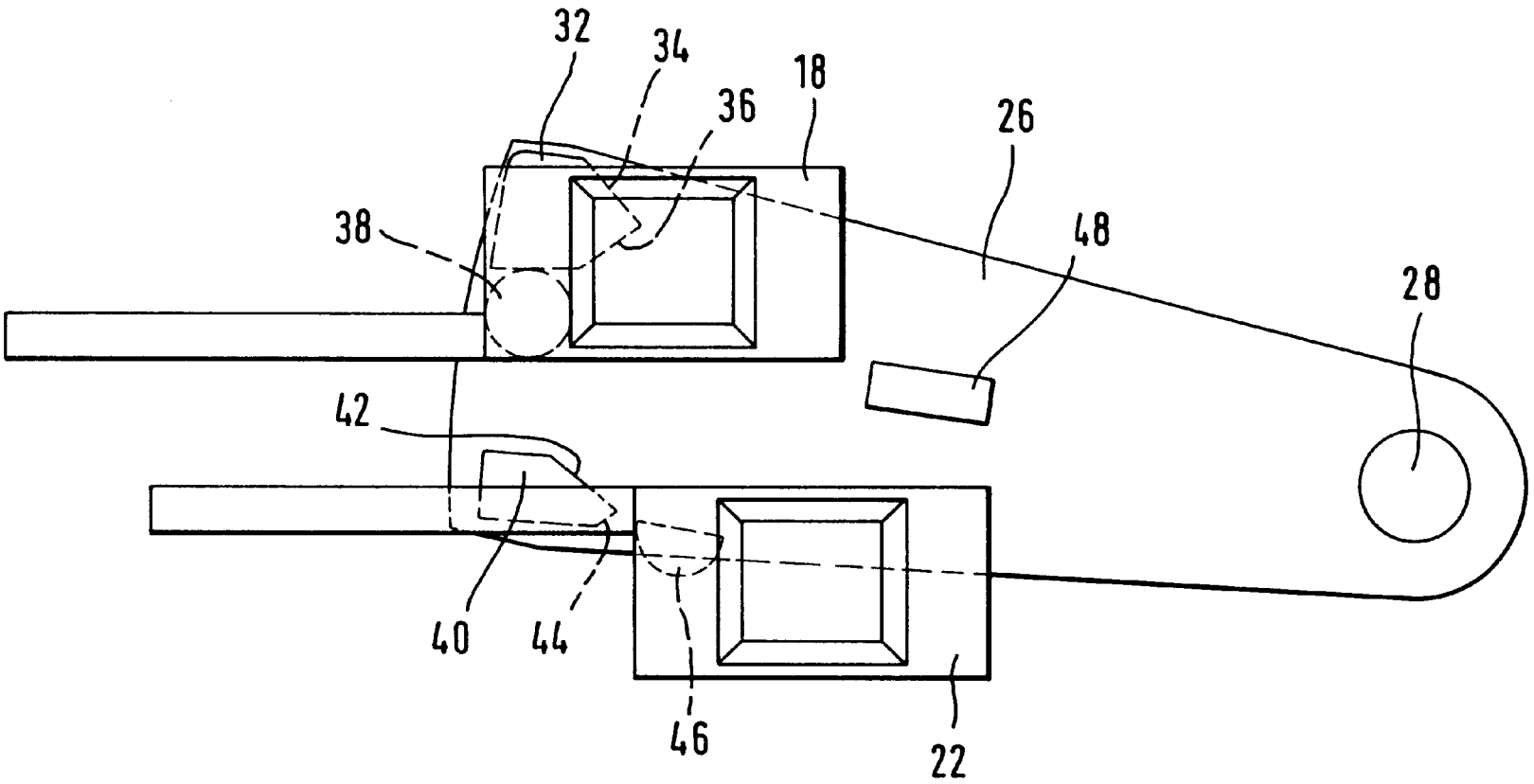

If the second adjusting nut 22, which acts on the operating lever for the external door handle, is moved out of the position shown in FIG. 3 into its locking position, in which the connection of the external door handle to the door lock is interrupted or deadlocked, corresponding to the centrally locked position, the second actuating cam 46 will, during the operating movement, strike the upper inclined lifting flank 42 of the second control cam 40, thereby swiveling the operating element 26 downwards in the illustration shown counter to an accumulating return force of the return spring 30. Under the swiveling movement of the operating element 26 the upper inclined lifting flank 34 of the first control cam swivels into the moving path of the first actuating cam 38 on the first adjusting nut 18, so that on subsequent actuation of the first adjusting nut the operating element 26 is swiveled further downwards until the locking cam 48 swivels into the moving path of the second adjusting nut 22. Canceling of the locking position of the external door handle is thereby no longer possible, since the second operating lever 14 is deadlocked in its locked position, and on operation of the internal door handle the unlocking mechanism is similarly deadlocked.

Disengagement, that is an interruption of the unlocking mechanism between the internal door handle and the second operating lever 14 is also conceivable instead of deadlocking by means of the locking cam 48. The position of the adjusting nuts 18, 22 and the operating element 26 shown in FIG. 5 therefore corresponds to the central security function position of the central locking, which as anti-theft protection prevents opening of a vehicle door even after the side windows have been smashed in. As soon as the two adjusting nuts 18, 22 are returned to their initial position, the operating element 26, under the action of the return spring 30, swivels back into its neutral inoperative position, and the original centrally unlocked state represented in FIG. 3 is resumed.

If, from this condition, the first adjusting nut 18 is first shifted from the inoperative position into its activated position by corresponding actuation of its drive motor, the first actuating cam 38 does not strike the upper inclined flank 34, but the lower inclined flank 36 of the first control cam 32. This causes the operating element 26 to swivel upwards in the representation shown, so that the upper inclined lifting flank 42 of the second control cam 40 is swiveled out of the moving path of the second actuating cam 46. In the position of the central locking drive shown in FIG. 6 the connection of the internal door handle to the door lock is interrupted while the connection to the external door lock is maintained, that is to say the child safety function is activated in the central unlocking condition of the central locking.

If the second adjusting nut 22 is now shifted into its activated position, the second actuating cam 46 runs counter to the lower inclined lifting flank 44 of the second control cam 40 and displaces the operating element 26 upwards by a further distance, in which process the locking cam 48 does not obstruct the adjusting nuts 18, 22. In this position it is not possible to open the door either by operating the external door handle or by operating the internal door handle, that is to say the child safety function is activated in the central locking position of the central locking. By operating the internal door handle, however, the second adjusting nut 22 can be returned to its inoperative position so that the locking of the external door handle can be canceled by operating the internal door handle. This is highly desirable for safety reasons in order to facilitate access to the rear bench seat of a vehicle in the event of accidents.

Figure 7:
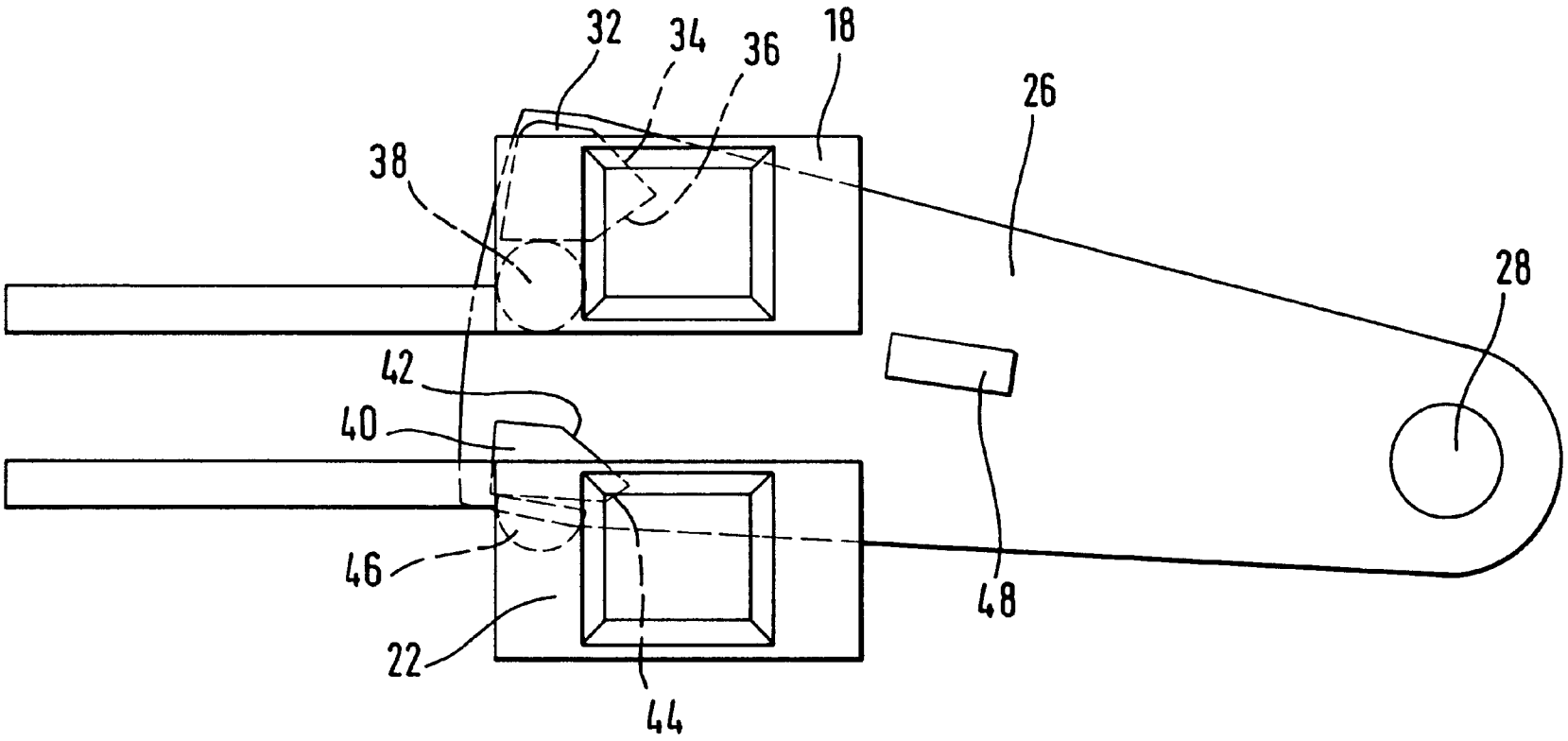

Instead of deadlocking the locking of the external door handle in the central security position it is also feasible to omit the locking cam 48 and to create the facility for unlocking the external door handle by operating the internal door handle only in the position of the central locking drive represented in FIG. 7 through a corresponding operating action of the operating element 26.

Instead of a pivotably arranged operating element 26 it is also feasible to guide this linearly or to support it so that it can rotate about a longitudinal axis. Instead of designing the support elements for the actuating cams 38, 46 as adjusting nuts rotary driven elements may be provided, which act, for example, by way of a shaft and hollow shaft on radial pins in order to interrupt the connection between the external door handle or the internal door handle and the door lock.

The operating levers 12, 14 and the actuating cams 38, 46 may in principle also be operated by linear motors, electromagnets or other drive elements.

I claim:

1. Central locking drive for actuation of various locking functions of a door lock, especially in motor vehicles with two drive members (18, 20, 22, 24), which are each adjustable between an inoperative position and an activated position, wherein an operating element (26) is provided, which is moveable between a neutral position, assumed when the two drive members (18, 20, 22, 24) assume their inoperative position, and at least one operating position, attainment of a particular operating position of the operating element (26) being dependent upon order in which the two drive members (18, 20, 22, 24) are activated, wherein interacting cam elements (32, 38, 40, 46) are provided on the operating element (26) and on each of the drive members (18, 22) respectively, which on activation of a first of sail drive members (18) cause the operating element (26) to be shifted into a first intermediate position and on subsequent activation of a second of said drive members (22) cause the operating element (26) to be shifted further into a first operating position, and on initial activation of the second drive member (22) cause the operating element (26) to be shifted into a second intermediate position and on subsequent activation of the first drive member (18) cause the operating element (26) to be shifted into a limit position or second operating position other than the first operating position.

2. Central locking drive as claimed in claim 1, wherein the cam elements (32, 40) on the operating element (26) have lifting flanks (34, 36, 42, 44) inclined in relation to direction of movement of the cam elements (38, 46) on the drive members (18, 22).

3. Central locking drive, for actuation of various locking functions of a door lock, especially in motor vehicles with two drive members (18, 20, 22, 24), which are each adjustable between an inoperative position and an activated position, wherein an operating element (26) is provided, which is moveable between a neutral position, assumed when the two drive members (18, 20, 22, 24) assume their inoperative position, and at least one operating position, attainment of a particular operating position of the operating element (26) being dependent upon order in which the two drive members (18, 20, 22, 24) are activated, wherein the drive members (18, 22) have electric drive motors which each is traverseable between two stops which represent the inoperative position or the activated position of the respective drive member.

4. Central locking drive as claimed in claim 3, wherein a first of said drive members (18, 20), in the activated position, deadlocks or interrupts a connection between an internal door handle and the door lock, and a second of said drive members (22, 24), in its activated position, deadlocks or interrupts a connection between an external door handle and the door lock.

5. Central locking drive as claimed in claim 4, wherein the operating element (26) is moveable by operation of the first drive member (18, 20) and subsequent operation of the second drive member (22, 24) into a first operating position, in which the external door handle is unlockable by operating the internal door handle.

6. Central locking drive as claimed in claim 3, the operating element (26) in one operating position interrupts or deadlocks a facility for unlocking an external door handle by an internal door handle.

7. (currently amended) Central locking drive as claimed in claim 3, wherein a return spring (30) is provided, which returns the operating element (26) towards its neutral position.

8. Central locking drive as claimed in claim 3, wherein said drive motors drive spindles (20, 24), which engage with adjusting nuts (18, 22), on which cam elements (38, 46) are arranged.

9. Central locking drive as claimed in claim 3, wherein the operating element (26) is pivotably mounted.

* * * * *